US009288571B2

(12) United States Patent
Christner et al.

(10) Patent No.: US 9,288,571 B2
(45) Date of Patent: Mar. 15, 2016

(54) BASS REFLEX LOUDSPEAKER SYSTEM WITH PHASE CORRECTION ELEMENT

(71) Applicant: d&b audiotechnik GmbH, Backnang (DE)

(72) Inventors: Matthias Christner, Ludwigsburg (DE); Nico Paul, Remseck (DE)

(73) Assignee: d&b audiotechnik GmbH, Backnang (DE)

( * ) Notice: Subject to any disclaimer, the term of this patent is extended or adjusted under 35 U.S.C. 154(b) by 0 days.

(21) Appl. No.: 14/494,804

(22) Filed: Sep. 24, 2014

(65) Prior Publication Data

US 2015/0086057 A1 Mar. 26, 2015

(51) Int. Cl.

| | |
|---|---|
| ***H04R 1/02*** | (2006.01) |
| ***H04R 1/28*** | (2006.01) |
| ***H04R 1/34*** | (2006.01) |

(52) U.S. Cl.

CPC ..... *H04R 1/2819* (2013.01); *H04R 1/2815* (2013.01); *H04R 1/2826* (2013.01); *H04R 1/347* (2013.01); *H04R 2201/029* (2013.01); *H04R 2201/34* (2013.01)

(58) Field of Classification Search

CPC ..... H04R 1/28; H04R 1/30; H04R 1/34; H04R 1/345; H04R 1/2803; H04R 1/2815; H04R 1/2819; H04R 1/2834; H04R 1/2842; H04R 1/2869; H04R 1/347; H04R 5/033; H04R 2201/029; H04R 2201/34

USPC ..... 381/338, 339, 340, 342, 343, 345, 349, 381/350, 351, 370, 371, 374, 182, 186; 181/152, 155, 156, 159, 185, 199

See application file for complete search history.

(56) References Cited

U.S. PATENT DOCUMENTS

| | | | | |
|---|---|---|---|---|
| 4,157,741 | A | 6/1979 | Goldwater | |
| 5,432,860 | A * | 7/1995 | Kasajima et al. | 381/349 |
| 5,590,208 | A * | 12/1996 | Koyano et al. | 381/338 |
| 5,778,084 | A * | 7/1998 | Kling et al. | 381/97 |
| 5,872,339 | A | 2/1999 | Hanson | |
| 2004/0264727 | A1 * | 12/2004 | Kim | 381/370 |

FOREIGN PATENT DOCUMENTS

| | | | |
|---|---|---|---|
| DE | 4424995 | A1 | 1/1996 |
| DE | 19601217 | C1 | 7/1997 |
| DE | 102006058009 | B3 | 2/2008 |
| DE | 202012002412.4 | U1 | 4/2012 |
| EP | 0409475 | A1 | 1/1991 |
| WO | 03032677 | A2 | 4/2003 |
| WO | 2009093978 | A1 | 7/2009 |

OTHER PUBLICATIONS

German Office action, 6 pages, dated Jul. 25, 2014.

* cited by examiner

*Primary Examiner* — Huyen D Le

(74) *Attorney, Agent, or Firm* — Cooper Legal Group, LLC

(57) ABSTRACT

A loudspeaker system has a loudspeaker housing that comprises at least a first and a second housing chamber. The loudspeaker system has a bass loudspeaker that is mounted on a partition between the first housing chamber and the second housing chamber, wherein the back of the bass loudspeaker has the first housing chamber present and the front of the bass loudspeaker has the second housing chamber present. The partition contains at least one bass reflex opening. A phase correction element is arranged at the front of the bass loudspeaker in the second housing chamber. The bass reflex opening opens into the second housing chamber and is arranged in a region adjacent to the phase correction element.

19 Claims, 4 Drawing Sheets

BASS REFLEX LOUDSPEAKER SYSTEM WITH PHASE CORRECTION ELEMENT

RELATED APPLICATIONS

This application claims priority to German Patent Application 10 2013 110 535.1, filed on Sep. 24, 2013, which is incorporated herein by reference.

TECHNICAL FIELD

The disclosure relates to a bass reflex loudspeaker system with a phase correction element.

BACKGROUND

Bass reflex loudspeaker systems are frequently used in sound engineering. In bass reflex loudspeaker systems, the loudspeaker housing is not closed, but rather provided with a channel leading to the outside. The term ventilated or vented systems is also used. The sound component radiated backwards from the loudspeaker is used in order to increase the efficiency of the loudspeaker system in the region of the resonant frequency of the loudspeaker system. It is possible to achieve significantly increased sound pressure levels and an extension of the power bandwidth.

SUMMERY

An object of various embodiments can be considered to be that of providing a loudspeaker system having good sound properties, small physical size and/or a high sound pressure level.

The loudspeaker system may comprise a loudspeaker housing that has at least a first and a second housing chamber. A bass loudspeaker is mounted on a partition (partition board) between the first housing chamber and the second housing chamber, wherein the sound at the back of the bass loudspeaker is radiated into the first housing chamber and the sound at the front of the bass loudspeaker is radiated into the second housing chamber.

Further, a loudspeaker system having a loudspeaker, a first housing chamber into which the bass loudspeaker radiates at the back and that forms a first resonator, a second housing chamber into which the bass loudspeaker radiates at the front and that forms a second resonator, a bass reflex resonator that interacts with the first resonator, and a phase correction element, which is accommodated in the second housing chamber, for decreasing the mode acuity of the second resonator is disclosed. At least one portion of the bass reflex resonator may, e.g., be arranged in the second housing chamber adjacent to the phase correction element.

BRIEF DESCRIPTION OF THE DRAWINGS

Embodiments of the disclosure are explained below using exemplary embodiments with reference to the drawings, in which.

Figure 1:
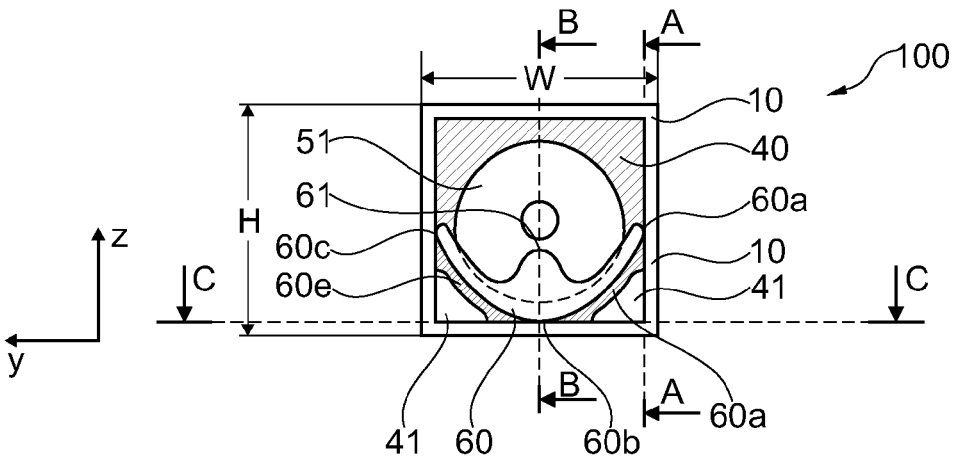
FIG. 1 is a schematic front view of an exemplary loudspeaker system.

In the appended drawings, the same or similar parts are denoted by the same reference symbols. The dimensions shown in the Figures may be but are not necessarily to scale. The disclosure content of the drawings is therefore intended to entail both a specific, to-scale understanding of these Figures and a more general, not-to-scale understanding of the Figures in the sense of schematic illustrations. In addition, housing walls (e.g. bottom wall and top wall, side walls) that are shown parallel to one another in the Figures may be oriented parallel to one another, but in general it is also possible to have such walls in orientations inclined toward one another.

Features that are explained with reference to different embodiments can be combined with one another if they are not alternative features. By way of example, that is to say that elements explained with reference to one of the embodiments, for example the phase correction element and the various housing chambers and resonators, and also the properties thereof may also apply to the corresponding elements and the properties thereof in another embodiment.

DETAILED DESCRIPTION

It is to be understood that the features of the various exemplary embodiments described herein may be combined with each other, unless specifically noted otherwise.

The loudspeaker system described herein may have at least one bass reflex opening in the partition and a phase correction element that is arranged at the front of the bass loudspeaker in the second housing chamber. In this case, the bass reflex opening may open into the second housing chamber and may be arranged in a region adjacent to the phase correction element.

This adjacent physical arrangement of the phase correction element and the bass reflex opening may allow a space-saving design. A bass reflex channel (or duct) adjoining the bass reflex opening can have at least sections running in the second housing chamber and can be displaced therein into an otherwise "dead" volume, for example, in a region adjacent to the phase correction element, for example bounded by the back of the phase correction element. A loss of volume in the first housing chamber as the result of a bass reflex channel that, according to conventional design, projects into the first housing chamber can therefore be avoided or at least reduced.

This additionally usable volume in the first housing chamber may make the resonator formed by the first housing chamber more efficient, which results in a sound pressure level increase at its resonant frequency. At the same time or alternatively, a reduction in the physical size of the first housing chamber and hence of the entire loudspeaker housing in comparison with the conventional design with a bass reflex channel fully present in the first housing chamber can be achieved for a prescribed maximum sound pressure level.

The phase correction element, for example what is known as a phase plug, may have a flat, curved or else wing-shaped form. The form of the phase correction element produces a volume geometry in the second housing chamber that suppresses any undesirable higher resonance mode as far as possible, but in so doing impairs the desired fundamental resonance of the second housing chamber as little as possible. Above the fundamental resonance, the phase correction element thus prompts mode extension or a decrease in mode quality. The phase correction element attenuates or eliminates discrete or acute modes of the resonator, which impair the sound, at the front of the bass loudspeaker.

The phase correction element can extend radially outward from a central region—with reference to the direction of radiation—of the loudspeaker on both sides. By way of example, it can extend in the radial direction beyond the loudspeaker edge and possibly at least in sections as far as the edge of the loudspeaker housing.

The bass reflex opening provided in the partition may be formed in the region of a corner of the first housing chamber or of the loudspeaker housing. This makes it possible to obtain a space-saving design with a comparatively small physical size.

In addition, provision may be made for a wall section of the phase correction element to form a wall region of a bass reflex channel containing the bass reflex opening. This design allows a saving on material, since separate ducts or the like, as are conventionally used for a bass reflex channel, can be dispensed with at least in the region of the phase correction element.

In addition, a wall region of a bass reflex channel containing the bass reflex opening may be formed by at least one wall section of the second housing chamber, particularly by two mutually perpendicular wall sections of the second housing chamber. This measure likewise allows the achievement of a saving on material in the sense described above (use of the wall sections as a wall region of a bass reflex channel).

A bass reflex channel comprising the bass reflex opening can extend over less than 50% of its length, particularly over less than 30% of its length—and possibly not at all—into the first housing chamber. The use of a partial volume of the second housing chamber for the bass reflex channel allows the latter to be accommodated predominantly or possibly completely in the second housing chamber. This measure increases the effective volume of the first housing chamber, which acts as a resonator volume. The housing size can therefore be decreased for a desired maximum sound pressure level or the maximum achievable sound pressure level can be increased for a prescribed housing size.

A bass reflex channel containing the bass reflex opening may have a sound exit opening that is situated between at least one housing wall of the second housing chamber and a contour line of the phase correction element. Hence, the (otherwise "dead") volume on the outside or back of the phase correction element can be used as a resonator volume for the bass reflex channel.

The sound exit opening of the bass reflex channel may be situated in a corner region of the second housing chamber. In this case, the volume in the corner region of the second housing chamber can be used as a resonator volume for the bass reflex channel.

A further possible variant embodiment involves the partition running at an inclination with respect to a back housing wall. This measure allows the physical height of the loudspeaker housing to be reduced further on account of the oblique installation position of the bass loudspeaker.

With an inclined partition, provision may be made for a bass reflex channel containing the bass reflex opening to extend at least from the rear end of the partition to the front end of the partition. That is to say that that section in the second housing chamber that is defined by the oblique position of the partition can be used to increase the volume of the bass reflex channel.

The loudspeaker system described herein may further comprise a further bass loudspeaker that is mounted on a further partition between the first housing chamber and the second housing chamber or a third housing chamber of the loudspeaker housing, wherein the back of the further bass loudspeaker has the first housing chamber present and the front of the further bass loudspeaker has the second or third housing chamber present. At least one further bass reflex opening may be present in the further partition. In addition, a further phase correction element may be present that is arranged at the front of the further bass loudspeaker in the second or third housing chamber. The further bass reflex opening can open into the second or third housing chamber and be arranged in a region adjacent to the further phase correction element.

Both the partition and the further partition can each run at an inclination with respect to a back housing wall. The effect that can be achieved by this is that there is a shorter distance between the two bass loudspeakers or the focus of radiation thereof. This reduces the height of the loudspeaker housing and promotes the physical radiation response toward high frequencies of the bass loudspeakers.

The loudspeaker system may further comprise a horn loudspeaker. The horn loudspeaker may be arranged between the bass loudspeaker and the further bass loudspeaker.

A sound exit opening of the bass reflex resonator may be arranged between a contour line of the phase correction element and a wall of the second housing chamber, particularly in a corner region of the second housing chamber. In addition, more than 50%, for example more than 80% and particularly 100%, of the air volume of the bass reflex resonator may be situated in the second housing chamber. These measures make it possible to attain a space-saving design and/or a high maximum sound pressure level for a given housing size, as already described.

FIGS. 1 to 4 schematically show an exemplary embodiment of a loudspeaker system 100 in various illustrations. The loudspeaker system 100 has a loudspeaker housing 10 that forms a first housing chamber 20 and a second housing chamber 30. A bass loudspeaker 50 is mounted on a partition 40 that separates the first housing chamber 20 from the second housing chamber 30.

Figure 2:
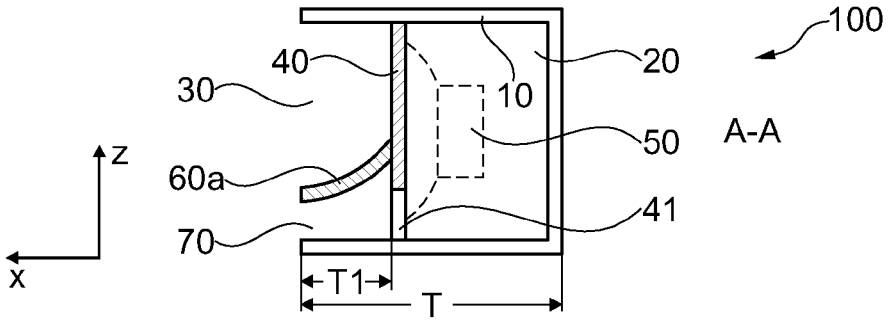
FIG. 2 is a sectional view of the loudspeaker system shown in FIG. 1 along the sectional line A-A.
Figure 3:
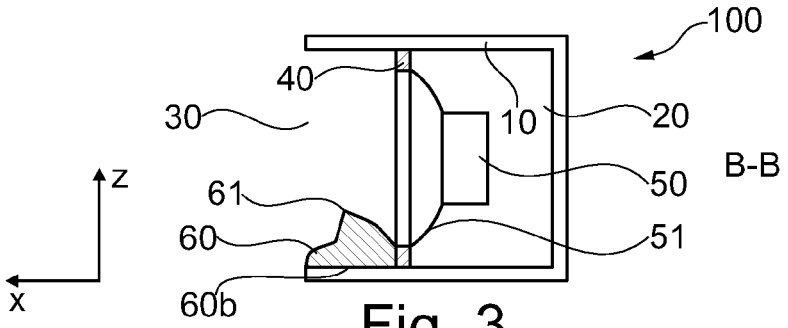
FIG. 3 is a sectional view of the loudspeaker system shown in FIG. 1 along the sectional line B-B.
Figure 4:
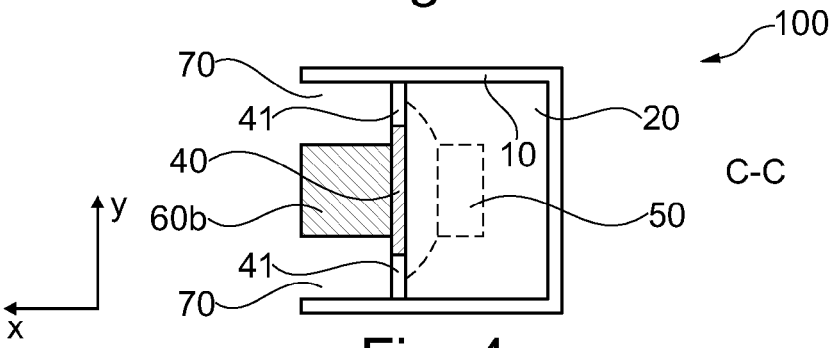
FIG. 4 is a sectional view of the loudspeaker system shown in FIG. 1 along the sectional line C-C.

By way of example, the loudspeaker housing 10 may have a width W in the y direction, a height H in the z direction and a depth T in the x direction. W, H and T may each be larger than 20 cm, 40 cm, 60 cm, 80 cm, 100 cm, with W, H and T being able to assume different values. As FIG. 1 shows, the loudspeaker housing 10 may have a rectangular cross section in front view. As FIGS. 2 and 3 show, the loudspeaker housing 10 may have a rectangular cross section, for example, in the x-z plane. According to FIG. 4, the cross section of the loudspeaker housing 10 in the x-y plane may also be rectangular, for example, and tapering housing shapes in the −x direction, i.e. in the opposite direction to the main direction of radiation x, are also possible.

The bass loudspeaker 50 radiates its front sound into the second housing chamber 30 and its backward sound into the first housing chamber 20. The first housing chamber 20 may contain—not shown—further chambers and/or further loudspeakers, see also FIGS. 9 to 12.

The first housing chamber 20 is connected to the second housing chamber 30 via at least one opening 41. The opening 41 is subsequently referred to as a bass reflex opening. In the embodiment of the loudspeaker system 100 that is shown here, the partition 40 contains a plurality of, for example, two bass reflex openings 41.

The one or more bass reflex opening(s) 41 may be situated in corner regions of the loudspeaker housing 10, for example. The bass reflex openings 41 may be in the form of corner cutouts in the partition 40. In this case, the bass reflex openings 41 are bounded by wall sections of the loudspeaker housing 10 that adjoin the corners and by an edge of the respective cutout in the partition 40.

Figure 5:
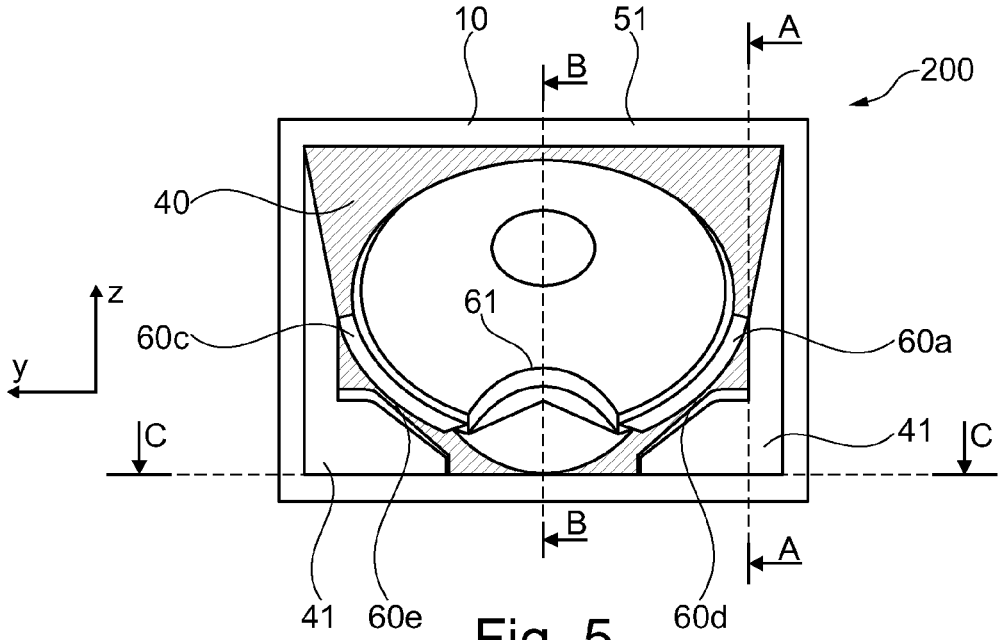
FIG. 5 is a perspective front view of an exemplary loudspeaker system with an obliquely running partition.

The bass reflex openings 41 may have an approximately triangular shape, as can be seen in FIG. 1 and also in FIG. 5, for example. This form allows a large opening area to be achieved for simultaneously relatively small housing dimensions. Other shapes, e.g. a circular shape, are likewise possible.

Situated in the main direction of radiation x in front of the bass loudspeaker 50 is a phase correction element (phase plug) 60. The phase correction element 60 may have a flat-curved, wing-shaped or spade-shaped form. By way of example, as can be seen in FIGS. 1 to 4, it may have a basin-shaped form with raised edges with respect to the y dimension. Provided in the middle region of the phase correction element 60, there may be a boss 61 that protrudes into the second housing chamber 30 in the z direction.

One or more side wall region(s) 60*a*, 60*c* and/or a bottom wall region 60*b* of the phase correction element 60 may be in contact with housing walls of the second housing chamber 30 or otherwise connected to the latter and may form an airtight closure with said housing walls, for example. The outer wall sections 60*d*, 60*e* of the phase correction element 60, which lie between the side wall regions 60*a*, 60*b*, 60*c* of the phase correction element 60 that close the housing walls, can form a wall region of a bass reflex channel (duct) 70 containing the bass reflex openings 41 in the X direction.

This means that the bass reflex channel 70 can be formed in the region of the second housing chamber 30 by wall areas of the second housing chamber 30 and/or by outer wall sections 60*d*, 60*e* of the phase correction element 60. It is possible for the bass reflex channel 70 in the second housing chamber 30 to be formed exclusively by housing wall areas and outer wall sections 60*d*, 60*e* of the phase correction element. In this case, it is not necessary for additional elements such as ducts or the like to be connected to the bass reflex openings 41 in the x direction in order to form a bass reflex channel. That is to say that the use of already present wall areas of the second housing chamber 30 and/or outer wall sections 60*d*, 60*e* of the phase correction element that are present can achieve a saving on material for the requisite production of the bass reflex channel 70.

However, it is also possible for the bass reflex channel 70 in the region of the second housing chamber 30 to be produced—not shown—by a length of duct that adjoins the bass reflex opening 41 and runs in the x direction. Such a length of duct (not shown) can extend in the x direction between the outer wall section 60*d* or 60*e* of the phase correction element 60 and the wall regions of the second housing chamber 30 that are close to the corners. The length of duct may have essentially the same cross-sectional opening as the bass reflex opening 41, i.e. may exhibit a triangular form in the broadest sense or else a circular-disk form, for example.

At least some portion of the bass reflex channel 70 can run within the second housing chamber 30 and be arranged there adjacent to the phase correction element 60. By way of example, the peripheral contour of the bass reflex channel 70 may match the contour of an outer wall section 60*d* or 60*e* of the phase correction element 60 or can have at least sections formed directly by the outer wall section 60*d*, 60*e*, as described.

The bass reflex channel 70 can also project—not shown—into the first housing chamber 20 over a certain depth. By way of example, this can be produced by virtue of a length of duct (not shown) projecting from the bass reflex opening 41 into the first housing chamber 20 in a manner known per se. In this case, the length of such a length of duct projecting into the first housing chamber 20 can be kept short, for example shorter than the length T1 of the bass reflex channel 70 in the second housing chamber 30. That is to say that the bass reflex channel frequently provided within the loudspeaker housing chamber 20 in conventional embodiments can be displaced in the loudspeaker housing 100 partially or completely into the second housing chamber 30, where it can be accommodated in space-saving fashion in a region that is acoustically shielded by the phase correction element 60 and hence represents a "dead" volume so to speak. In this case, as already described, outer wall sections 60*d*, 60*e* of the phase correction element 60 can be used to bound the bass reflex channel 70, which additionally allows a saving on material to be attained.

Housing chambers and bass reflex channels each form acoustic resonators. The first housing chamber 20 with its internal volume forms a first resonator of the loudspeaker housing 10. This first resonator interacts with the bass reflex resonator provided by the internal volume of the bass reflex channel. The combination of internal volume and geometry of the openings 41 determines the resonant frequency. The respective external volumes that immediately adjoin the front of the diaphragms 51 of the bass loudspeaker 50 form a second resonator. In this case, the effective volume and the effective opening area determine the resonant frequency. The effective volume and the effective opening area are significantly influenced by the geometry of the open second housing chamber 30 into which the bass loudspeaker radiates at the front. The external volume that the second resonator contains therefore likewise produces a resonance and prompts moderate low-pass filtering of the radiated sound. The low-pass filtering is accompanied by a slight sound level increase.

Without the phase correction element, the second resonator would be able to be used only in a frequency range below its fundamental resonance. Above the fundamental resonance, discrete modes that impair the sound are usually established. The flat phase correction element 60 arranged inside the second housing chamber 30 and hence inside the second resonator is used to decrease the mode acuity of the second resonator, so that the latter can also be used in a frequency range above its fundamental frequency. The physical (spatial) radiation response of the loudspeaker system 100 is influenced by the flat phase correction element 60 (unlike in the case of an acoustic lens) only little or not at all, for example.

As explained with reference to FIGS. 1 to 4, at least one portion of the bass reflex resonator is formed in the second housing chamber 30 adjacent to the phase correction element 60 and is possibly bounded by the latter. This physical arrangement of the first resonator, the second resonator, the bass reflex resonator and the flat phase correction element 60 in the second resonator provides a space-saving and efficient geometry for the loudspeaker system 100, as already explained. In this case, the effect that can be achieved by suitable production of the bass reflex channel inside the second housing chamber 30 and optionally also inside the first housing chamber 20 is that more than 50%, particularly more than 80% and possibly 100%, of the air volume of the bass reflex resonator is situated in the second housing chamber 30. In this case, as already explained, a wall region of the bass reflex resonator in the second housing chamber 30 can be formed by an outer wall section 60*d*, 60*e* of the phase correction element.

The loudspeaker system 100 explained by way of example with reference to FIGS. 1 to 4 can be varied in many different ways. By way of example, further bass reflex openings may be provided in the partition 40 or, by way of example, also in the side wall or back wall of the first housing chamber 20. There may also be further loudspeakers, both bass loudspeakers and loudspeakers operating in other frequency ranges, accommodated in the partition 40 or in other walls.

Figure 6:
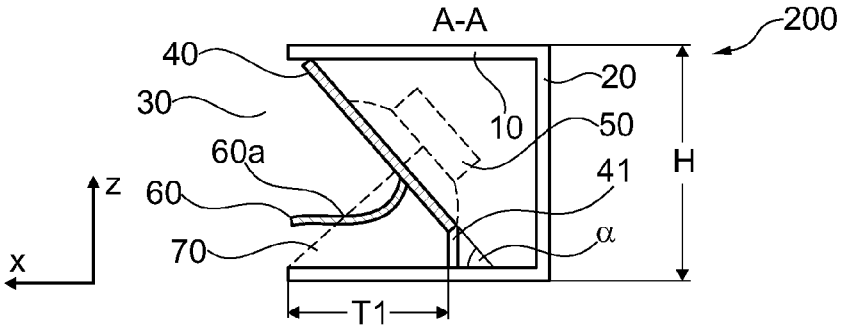
FIG. 6 is a sectional view of the loudspeaker system shown in FIG. 5 along the sectional line A-A.
Figure 7:
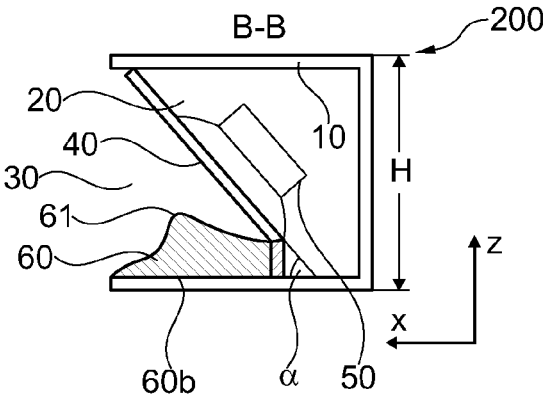
FIG. 7 is a sectional view of the loudspeaker system shown in FIG. 5 along the sectional line B-B.

FIGS. 5 to 7 show an exemplary loudspeaker system 200, which may be identical to the loudspeaker system 100 apart from oblique installation of the bass loudspeaker 50 in the loudspeaker housing 10. As can be seen from the sectional illustration in FIG. 6 (along the sectional line A-A in FIG. 5), the partition 40 may be inclined with respect to the bottom of the loudspeaker housing 10. The angle of inclination a between the bottom of the loudspeaker housing 10 and the partition 40 may be less than 80°, 70°, 60°, 50° or 40°, for example. In turn, the partition 40 divides the loudspeaker housing 10 into a first housing chamber 20 at the back of the bass loudspeaker 50 and an open, second housing chamber 30 at the front of the bass loudspeaker 50. Side wall regions 60*a* and 60*b* of the phase correction element can extend up to the lateral housing walls in the second housing chamber 30 and, in the manner already described, contribute to forming or accommodating the bass reflex channel 70. In the manner already described for the loudspeaker system 100, said bass reflex channel may optionally also have a duct section that projects into the first housing chamber 20, and it is also possible, on the basis of the description above, for the bass reflex channel 70 in the first housing chamber 10 to be formed by a separate length of duct that adjoins the opening 41 in the partition 40 in the x direction.

In other words, the arrangement of phase correction element 60, opening 41 and partition 40, and the form of the bass reflex channel 70 adjacent to the phase correction element 60, may be produced in the same manner as has already been described for the loudspeaker system 100. To avoid repetition, reference is made to the description above. However, the oblique installation of the partition 40 allows the use of a bass loudspeaker 50 having a greater diameter for a prescribed height H of the loudspeaker housing 10, or else a decrease in the height H of the loudspeaker housing 10 for a prescribed diameter of the bass loudspeaker 50.

In addition, FIG. 7 illustrates that, with oblique installation of the bass loudspeaker 50, the central axis of the loudspeaker can run past the phase correction element 60 more closely or intersect it, for example at its boss 61 (this being possible even with the loudspeaker system 100 having a partition 40 running perpendicularly to the housing bottom, however). Hence, oblique installation of the bass loudspeaker 50 promotes the action of the phase correction element 60, since the sound can be directed to the phase correction element 60 to a greater extent.

Figure 8:
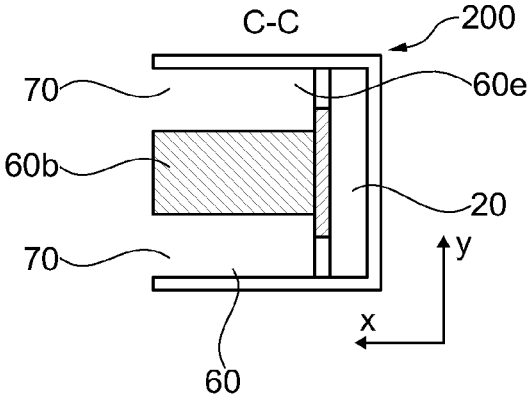
FIG. 8 is a sectional view of the loudspeaker system shown in FIG. 5 along the sectional line C-C.

FIG. 8 illustrates that, in comparison with the loudspeaker system 100, oblique installation allows a longer phase correction element 60 and/or a longer bass reflex channel 70 (i.e. a greater bass reflex resonator volume in the second housing chamber 30) for the same housing dimensions.

Figure 9:
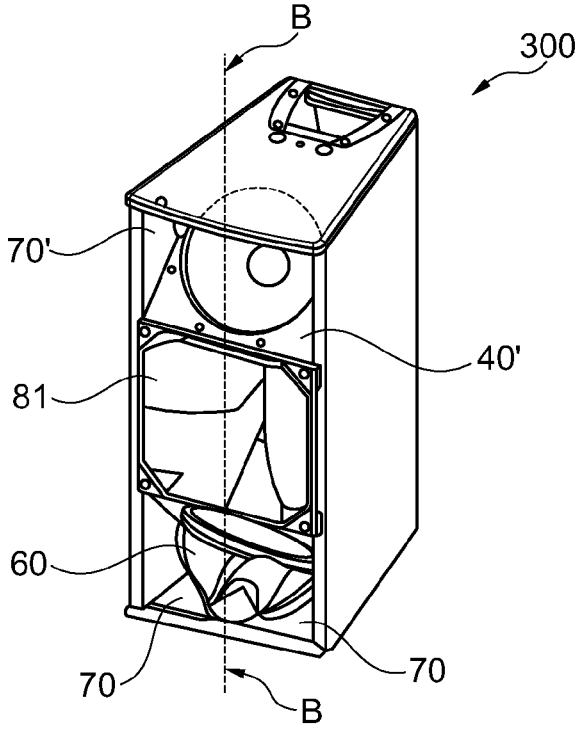
FIG. 9 is a perspective view of an exemplary loudspeaker system with two bass loudspeakers.
Figure 10:
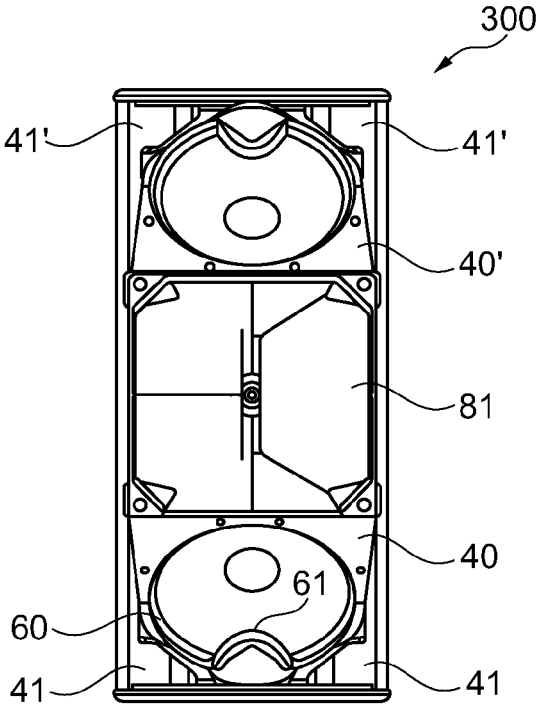
FIG. 10 is a front view of the loudspeaker system shown in FIG. 9.
Figure 11:
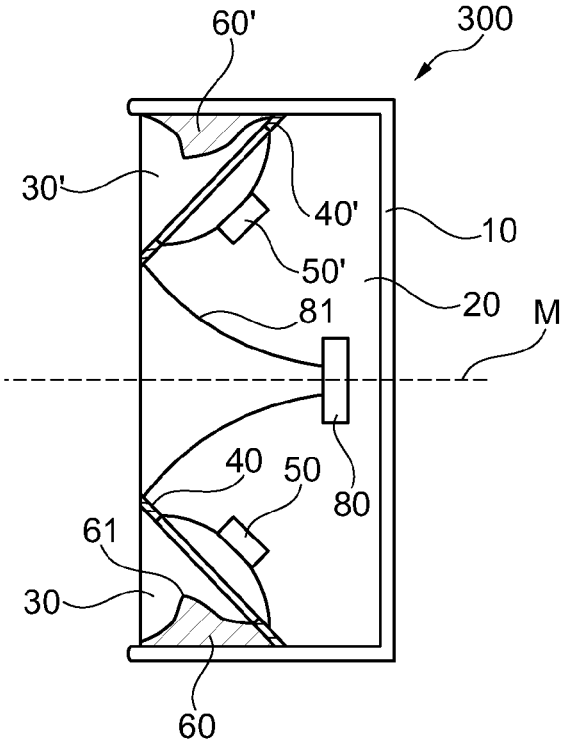
FIG. 11 is a sectional view of the loudspeaker system shown in FIG. 9 along the sectional line B-B.

FIGS. 9 to 11 schematically show an exemplary embodiment of a loudspeaker system 300 in various illustrations. The loudspeaker system 300 has a loudspeaker housing 10 that comprises a first housing chamber 20 and also a second housing chamber 30 and a third housing chamber 30'. In addition, the loudspeaker system 300 has a further bass loudspeaker 50' in addition to the bass loudspeaker 50 already described. The further bass loudspeaker 50' may be identical to the bass loudspeaker 50. The bass loudspeaker 50 radiates into the first housing chamber 20 at the back and into the second housing chamber 30 at the front. The further bass loudspeaker 50' radiates into the third housing chamber 30' at the front and into the common first housing chamber 20 at the back. However, provision may also be made for the first housing chamber 20 to be divided, by way of example, such that a separate resonator volume is provided for each of the two bass loudspeakers 50, 50'. In addition, provision may be made—not shown—for the second housing chamber 30 and the third housing chamber 30' to form a common housing chamber, for example when the loudspeakers 50, 50' are positioned adjacently and—instead of in a manner directed away from one another as in FIGS. 9 to 11—obliquely in a manner directed toward one another.

In the loudspeaker system 300, a respective phase correction element 60 or 60' is arranged at the front of the two bass loudspeakers 50, 50' in the manner already described. In addition, bass reflex openings 41 and 41' in the respective partitions 40 and 40' between the first housing chamber 20 and the second housing chamber 30 and between the first housing chamber 20 and the third housing chamber 30' are provided. The bass reflex openings 41 and 41' open into the second housing chamber 30 and the third housing chamber 30', respectively, in a region adjacent to the respective phase correction elements 60, 60', see the description above.

As can be seen from the Figures, the two partitions 40, 40' may both be installed in the loudspeaker housing 10 at an inclination, as has been explained previously with reference to FIGS. 5 to 8. The overall design of the loudspeaker system 300 may be symmetrical with respect to a center line M.

The loudspeaker system 300 may also have a further loudspeaker, e.g. a horn loudspeaker 80. The horn loudspeaker 80 may be situated between the two bass loudspeakers 50, 50'. A horn 81 of the horn loudspeaker 80 can take up a large part of or practically the whole region between the two partitions 40, 40', for example. As can be seen from FIG. 10, the dimensions of the horn 81 in respect of the height thereof may be comparable to or else greater than the height H of the second and third housing chambers 30, 30'.

The effect that can be achieved by the arrangement with the respective oblique installation of the bass loudspeakers 50, 50'—as explained by way of example with reference to FIGS. 9 to 11—is that the loudspeaker housing 10 has a comparatively small height overall and the distance between the centers of the sound radiation from the two bass loudspeakers 50, 50' is kept comparatively short. The formation of the bass reflex resonators (bass reflex channels 70, 70') allows the volume of the respective bass reflex resonators to be largely or completely displaced, in the manner already described, into a space that is present on the outside or back of the respective phase correction element 60, 60', which space, as a "dead" volume, would otherwise have practically no acoustic function.

The physical height of the loudspeaker housing 10 shown in FIGS. 9 to 11 may be greater than 40 cm, 60 cm, 80 cm, 100 cm or 120 cm, for example. The width and depth of the loudspeaker housing 10 can correspond to the dimensions already cited for the loudspeaker systems.

Figure 12:
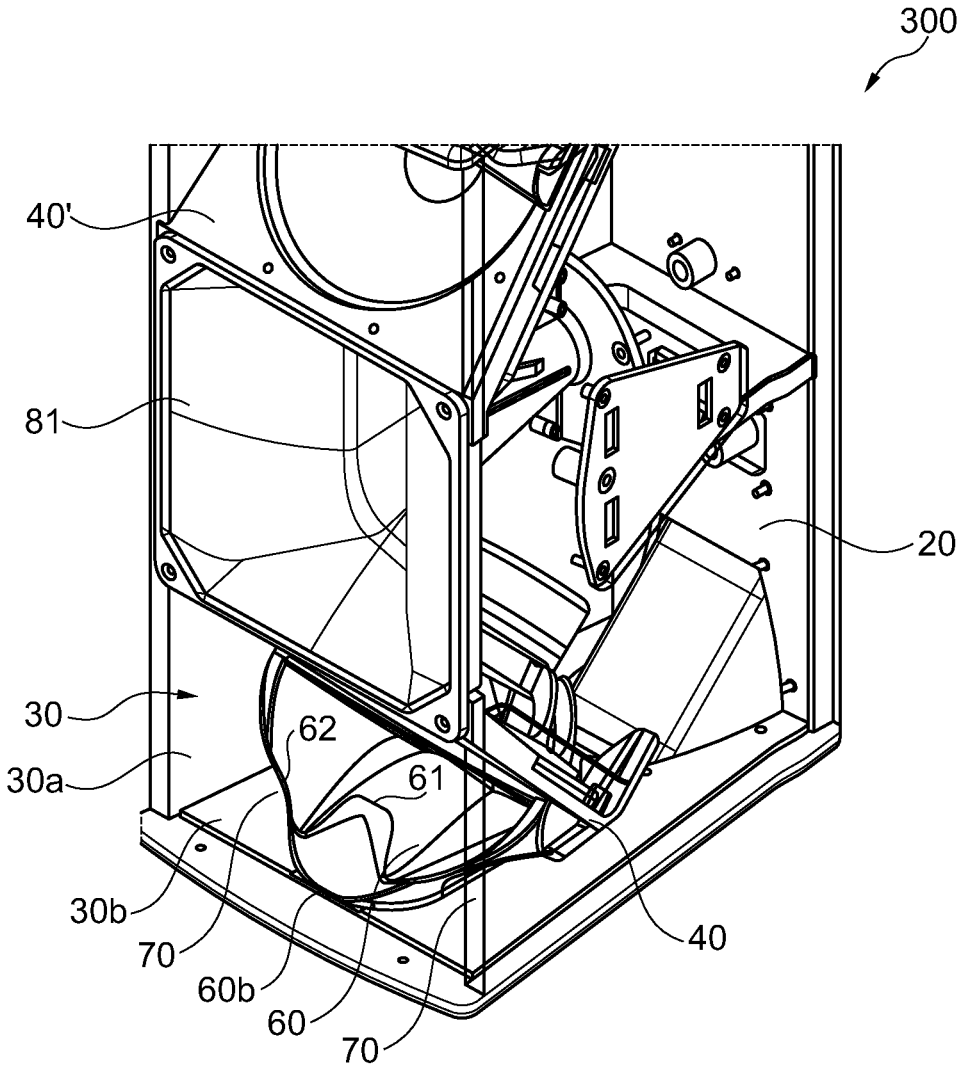
FIG. 12 is a perspective detail view of a region of FIG. 9.

FIG. 12 shows a semitransparent perspective view of a partial region of the loudspeaker system 300. As can be seen in FIG. 12, a sound exit opening of the bass reflex resonator or of the bass reflex channel 70 may be arranged between a contour line 62 of the phase correction element 60 and a side wall 30*a* and/or a bottom wall 30*b* of the second housing chamber 30. In the exemplary embodiment shown in FIG. 12, the contour line 62 of the phase correction element 60 extends from the side wall 30*a* up to the bottom wall 30*b*, i.e. the outside or back of the phase correction element 60 forms the bass reflex channel 70 together with the wall regions 30*a* and 30*b*. As already explained, however, provision may also be made for the bass reflex channels 70 each to be formed—in a manner that is not shown—by a separate length of duct that extends from the opening 41 in the partition between the outside of the phase correction element 60 and the wall regions 30*a*, 30*b*. In this case, the contour line 62 of the phase correction element may have a curvature that matches the curvature of the length of duct (not shown).

The form shown in FIG. 12 for the phase correction element 60 can be used in all the exemplary embodiments and it can be interpreted—by way of example—as being to scale. In general, however, it is to be noted that phase correction elements 60 have a high degree of form variability, and therefore shapes other than the forms shown in the present specification are also possible.

What is claimed is:

1. A loudspeaker system, comprising:

a loudspeaker housing having at least a first housing chamber and a second housing chamber, a bass loudspeaker that is mounted on a partition between the first housing chamber and the second housing chamber, wherein the first housing chamber is present at a back of the bass loudspeaker and the second housing chamber is present at a front of the bass loudspeaker, at least one bass reflex opening in the partition, and a phase correction element that is arranged at the front of the bass loudspeaker in the second housing chamber, wherein:

the phase correction element has a form of a wing, the wing comprising an inner wall section and an outer wall section opposite the inner wall section, the bass loudspeaker radiates sound onto the inner wall section, and the bass reflex opening opens into the second housing chamber and is arranged in a region to radiate sound onto the outer wall section.

2. The loudspeaker system as claimed in claim 1, wherein the phase correction element extends radially outward from a central region of the bass loudspeaker on both sides with reference to a direction of radiation.

3. The loudspeaker system as claimed in claim 1, wherein the bass reflex opening in the partition is formed in a region of a corner of the first housing chamber.

4. The loudspeaker system as claimed in claim 1, wherein the outer wall section of the wing of the phase correction element forms a wall region of a bass reflex channel containing the bass reflex opening.

5. The loudspeaker system as claimed in claim 1, wherein at least one wall section of the second housing chamber forms a wall region of a bass reflex channel containing the bass reflex opening.

6. The loudspeaker system as claimed in claim 1, wherein a bass reflex channel containing the bass reflex opening extends over less than 50% of its length in the first housing chamber.

7. The loudspeaker system as claimed in claim 1, wherein a bass reflex channel containing the bass reflex opening has a sound exit opening that is situated between at least one housing wall of the second housing chamber and a contour line of the phase correction element.

8. The loudspeaker system as claimed in claim 7, wherein the sound exit opening is situated in a corner region of the second housing chamber.

9. The loudspeaker system as claimed in claim 1, wherein the partition runs at an inclination with respect to a back housing wall.

10. The loudspeaker system as claimed in claim 9, wherein a bass reflex channel containing the bass reflex opening extends at least from a rear end of the partition to a front end of the partition.

11. The loudspeaker system as claimed in claim 1, further comprising:

a further bass loudspeaker that is mounted on a further partition between the first housing chamber and the second housing chamber or a third housing chamber of the loudspeaker housing, wherein the first housing chamber is present at a back of the further bass loudspeaker and the second housing chamber or the third housing chamber is present at a front of the further bass loudspeaker, at least one further bass reflex opening in the further partition, and a further phase correction element that is arranged at the front of the further bass loudspeaker in the second housing chamber or the third housing chamber, wherein:

the further bass reflex opening opens into the second housing chamber or third housing chamber and is arranged in a region adjacent to the further phase correction element.

12. The loudspeaker system as claimed in claim 11, wherein the partition and the further partition each run at an inclination with respect to a back housing wall.

13. The loudspeaker system as claimed in claim 11, further having:

a horn loudspeaker that is arranged between the bass loudspeaker and the further bass loudspeaker.

14. A loudspeaker system, comprising:

a bass loudspeaker, a first housing chamber into which the bass loudspeaker radiates at a back and that forms a first resonator, a second housing chamber into which the bass loudspeaker radiates at a front and that forms a second resonator, a bass reflex channel that interacts with the first resonator, and a phase correction element that is arranged at a front of the bass loudspeaker and accommodated in the second housing chamber for decreasing a mode acuity of the second resonator, wherein:

the phase correction element has a form of a wing, the wing comprising an inner wall section and an outer wall section opposite the inner wall section, the bass loudspeaker radiates sound onto the inner wall section, and at least one portion of the bass reflex channel is formed in the second housing chamber and runs adjacent to the outer wall section.

15. The loudspeaker system as claimed in claim 14, wherein a sound exit opening of the bass reflex channel is arranged between a contour line of the phase correction element and a wall of the second housing chamber.

16. The loudspeaker system as claimed in claim 14, wherein more than 50% of an air volume of the bass reflex channel is situated in the second housing chamber.

17. The loudspeaker system as claimed in claim 14, wherein a wall region of the bass reflex channel is formed by the outer wall section of the wing of the phase correction element.

18. A loudspeaker system, comprising:

a loudspeaker housing that has at least a first housing chamber and a second housing chamber, a bass loudspeaker that is mounted on a partition between the first housing chamber and the second housing chamber, wherein the first housing chamber is present at a back of the bass loudspeaker and the second housing chamber is present at a front of the bass loudspeaker, at least one bass reflex channel that is in connection with the first housing chamber, and a phase correction element that is arranged at the front of the bass loudspeaker in the second housing chamber, wherein:

the phase correction element has a form of a wing, the wing comprising an inner wall section and an outer wall section opposite the inner wall section, the bass loudspeaker radiates sound onto the inner wall section, and at least one subsection of the bass reflex channel extends in the second housing chamber and runs in a region adjacent to the outer wall section.

19. A loudspeaker system, comprising:

a loudspeaker housing having at least a first housing chamber and a second housing chamber, a bass loudspeaker that is mounted on a partition between the first housing chamber and the second housing chamber, wherein the first housing chamber is present at a back of the bass loudspeaker and the second housing chamber is present at a front of the bass loudspeaker, at least one bass reflex opening in the partition, a phase correction element that is arranged at the front of the bass loudspeaker in the second housing chamber, wherein:

the bass reflex opening opens into the second housing chamber and is arranged in a region adjacent to the phase correction element, a further bass loudspeaker that is mounted on a further partition between the first housing chamber and the second housing chamber or a third housing chamber of the loudspeaker housing, wherein the first housing chamber is present at a back of the further bass loudspeaker and the second housing chamber or the third housing chamber is present at a front of the further bass loudspeaker, a horn loudspeaker that is arranged between the bass loudspeaker and the further bass loudspeaker, at least one further bass reflex opening in the further partition, and a further phase correction element that is arranged at the front of the further bass loudspeaker in the second housing chamber or the third housing chamber, wherein:

the further bass reflex opening opens into the second housing chamber or third housing chamber and is arranged in a region adjacent to the further phase correction element.

* * * * *